US010871019B2

(12) United States Patent
Scheuring et al.

(10) Patent No.: US 10,871,019 B2
(45) Date of Patent: Dec. 22, 2020

(54) CLOSURE PANEL EXTENSION MECHANISM WITH MULTIPLE SPRINGS

(71) Applicant: Magna Closures Inc., Newmarket (CA)

(72) Inventors: Joseph Scheuring, Richmond Hill (CA); Wieslaw Nowicki, Mississauga (CA)

( * ) Notice: Subject to any disclaimer, the term of this patent is extended or adjusted under 35 U.S.C. 154(b) by 82 days.

(21) Appl. No.: 16/247,221

(22) Filed: Jan. 14, 2019

(65) Prior Publication Data

US 2019/0218841 A1 Jul. 18, 2019

Related U.S. Application Data

(60) Provisional application No. 62/617,404, filed on Jan. 15, 2018.

(51) Int. Cl.
*E05F 1/12* (2006.01)

(52) U.S. Cl.
CPC ..... *E05F 1/1238* (2013.01); *E05Y 2201/246* (2013.01); *E05Y 2201/416* (2013.01); *E05Y 2900/532* (2013.01); *E05Y 2900/548* (2013.01)

(58) Field of Classification Search
CPC ..... E05F 1/1238; E05Y 2201/246; E05Y 2201/416; E05Y 2900/532; E05Y 2900/548
See application file for complete search history.

(56) References Cited

U.S. PATENT DOCUMENTS 2,371,336 A 3/1945 Levon
2,738,972 A 3/1956 Morris
4,821,456 A 4/1989 Nogaki
5,187,993 A 2/1993 Nicholson et al.
5,295,407 A 3/1994 Hirose et al.
5,367,826 A 11/1994 Wu
5,944,376 A 8/1999 Buchanan, Jr.
6,185,868 B1 2/2001 Kato
6,516,567 B1 2/2003 Stone et al.
(Continued)

FOREIGN PATENT DOCUMENTS

DE 10001054 A1 6/2001
DE 10118303 C1 5/2002
(Continued)

*Primary Examiner* — Lori L Lyjak

(57) ABSTRACT

An extension mechanism for coupling with a closure panel to assist in opening and closing of the closure panel of a vehicle between a fully closed position and a fully open position of the closure panel, the extension mechanism including: an inner tube having an outer surface; an outer tube having an inner surface and overlapping the inner tube for at least a portion of the outer surface along an extension axis, such that the inner surface and the outer surface are adjacent to one another when overlapped; a first spring positioned along the extension axis in an interior of the outer tube; a second spring positioned along the extension axis in an interior of the inner tube; a seal positioned between the inner surface and the outer surface; and a stopper to engage the first spring at one end and engage the second spring at an opposite end such that the first spring and the second spring are in series with one another along the extension axis; wherein the one end and the opposite end are spaced apart from one another such that the seal is positioned between the one and opposite end.

20 Claims, 16 Drawing Sheets

(56) References Cited

U.S. PATENT DOCUMENTS

| | | | | |
|---|---|---|---|---|
| 6,755,458 | B1 | 6/2004 | Oberheide | |
| 6,814,392 | B1 | 11/2004 | Tomaszewski | |
| 7,566,092 | B2 | 7/2009 | Paton et al. | |
| 7,938,473 | B2 | 5/2011 | Paton et al. | |
| 9,776,483 | B2 | 10/2017 | Shchokin et al. | |
| 9,945,168 | B2 | 4/2018 | Leonard et al. | |
| 2003/0085589 | A1 | 5/2003 | Oberheide | |
| 2006/0043763 | A1 | 3/2006 | Berklich, Jr. et al. | |
| 2006/0082188 | A1 | 4/2006 | Mitchell | |
| 2007/0261310 | A1 | 11/2007 | Porat et al. | |
| 2010/0263285 | A1* | 10/2010 | Stull ..... | E06B 11/02 49/358 |
| 2017/0044814 | A1 | 2/2017 | Scheuring et al. | |

FOREIGN PATENT DOCUMENTS

| | | | |
|---|---|---|---|
| EP | 2226453 | A3 | 9/2010 |
| FR | 2814771 | A1 | 4/2002 |

* cited by examiner

CLOSURE PANEL EXTENSION MECHANISM WITH MULTIPLE SPRINGS

CROSS-REFERENCE TO RELATED APPLICATIONS

This application claims priority from U.S. provisional patent application No. 62/617,404, filed on Jan. 15, 2018; the entire contents of which are hereby incorporated by reference herein.

FIELD

This disclosure relates to a counterbalance mechanism for a closure panel.

BACKGROUND

Some vehicles are equipped with a closure panel, such as a lift gate, which is driven between an open position (position 2) and a closed position (position 1) using an electric drive system. Hold systems have been proposed to provide such vehicles with the capability of assisting the operator of the closure panel, in order to maintain a third position hold (or position 2) during opening and closing operations, so as to help counteract the weight of the closure panel itself. Without these hold systems, the closure panel may sag back down at the top end of the operational opening range due to the closure panel weight providing a closure torque greater than an opening torque provided by the electric drive system. Such proposed hold systems are, in some instances, complex and expensive and may not offer adequate failsafe modes (in the event of electric motor failure or loss of power) while at the same time maintaining adequate manual efforts by the operator.

The use of multiple springs in counterbalance mechanisms for telescoping tube arrangements are known, in attempting to as closely match as possible the counterbalance dynamics with the lift gate load curve so that the system remains balanced at any point of travel during the lift gate. If for example, these two components are balanced with one another, at any point the vehicle operator could stop movement of the lift gate and the lift gate would not move e.g. there would be no sag, no extra stress to the motor if provided. It is recognized that an unbalanced lift gate system would require more effort to move the lift gate, since the motor would have to take up the task of overcoming the unbalanced load of the lift gate. The current state of the art counterbalance systems with multiple springs employ a "kicker spring" operating in parallel with a main spring to move the lift gate, especially for travel of the lift gate from the initial gate closed position. The advantage of this parallel configuration is that it can reduce motor load requirements and manual efforts opening out of gate-closed position. However, one disadvantage is that the parallel configuration cannot make the spring K constant flatter in the Stop-and-Hold zone of the lift gate load curve.

However, even for parallel spring arrangements, the issue still remains that the kinematics of a typical Vehicle Lift gate (Mass, Center-of-Gravity, and Angles of Travel) creates a non-linear Lift gate Load Curve. A spring with a linear Load vs. Travel is typically used as a counterbalance to the non-linear Load Curve, recognizing that the difference between the Lift gate Load Curve and the Counterbalance Load Curve must be accommodated through 1) friction (to provide Stop-and-Hold functionality) and 2) demands on load and current of the Actuator Drive-Train (e.g. including an electrically powered motor) to provide power Open/Close functionality to the lift gate. Larger differences (less optimized) between the Lift gate Load Curve and the Counterbalance Load Curve can require larger amounts of friction (i.e. greater manual efforts) as well as higher loads and current (i.e. larger motor, gears, loads, current, etc.). Hence, a less optimized Counterbalance Load Curve can lead to inferior performance (i.e. less Stop-and-Hold, higher manual efforts, larger and more expensive drive-train, etc.) for the counterbalance system of the lift gate.

Another disadvantage in some telescoping-tube-type lift gate actuators and counterbalance mechanisms is that a seal is required in the middle of the length of the telescoping tubes, as a seal between the concentric tubes. However, the disadvantage is that this seal interrupts the space for spring coils (internal to the tubes) to travel freely. Unless accommodated, the presence of the seal can reduce the length available for spring coils by ~40-50%. The resulting shorter spring can have a consequence of limiting to lower loads (for the same stress-level) and a higher spring rate that typically has larger differences to the Lift gate Load Curve.

A further disadvantage of the presence of the seal, for a counterbalance with a telescoping tube construction, is that since the two concentric tubes have to be sealed together about the middle of the counterbalance (for example in an overlapping arrangement), the seal must be accommodated by a hump (or protrusion) that extends outwardly from the exterior surface of the outer tube of the telescoping tube arrangement. Therefore, in order to allow for the spring to extend past this seal, the seal must be provided between the inner tube and a hump in the outer tube. The presence of this hump increases the outer packaging space required around the counterbalance just for accommodating the seal. It is recognized that it is more desirable have a smooth outer tube, i.e. without the presence of the hump/protrusion, and thus a smaller diameter counterbalance which can lead to a more compact installation in the vehicle around the counterbalance. However if the seal was provided in the interior of the telescoping tubes, the travel of the spring and its diameter (i.e. smaller) would have to be changed, which would affect load curve matching abilities of the counterbalance.

Therefore, further disadvantages of current hold systems include bulky form factors which take up valuable vehicle cargo space, requirement to have additional lift support systems in tandem such as gas struts and other counterbalance mechanisms, unacceptable impact on manual open and close efforts requiring larger operator applied manual force at the panel handle, undesirable force spikes that do not provide for smoother manual force/torque curves, requirement to use vehicle battery power to maintain third position hold, and/or temperature effects resulting in variable manual efforts required by the operator due to fluctuations in ambient temperature.

SUMMARY

It is an object of the present invention to provide an extension mechanism that obviates or mitigates at least one of the above presented disadvantages.

A further objective is to maximize space (and potential energy) used for spring coils inside telescoping tube type counterbalance mechanism in order to best match the Load Curve (minimize differences) of the Lift gate mass, center of gravity, and angles of travel.

A further objective is to provide a means of sealing the counterbalance mechanism against water and debris intrusion while providing maximum space for spring coils to facilitate improvements in matching of the Lift gate load curve, recognizing that an improved match in load curve can provide for lift gate Stop-and-Hold and Hold-Open functionality while helping to minimize trade-offs in manual efforts and actuator drive-train loads and currents.

A first aspect provided is an extension mechanism for coupling with a closure panel to assist in opening and closing of the closure panel of a vehicle between a fully closed position and a fully open position of the closure panel, the extension mechanism including: an inner tube having an outer surface; an outer tube having an inner surface and overlapping the inner tube for at least a portion of the outer surface along an extension axis, such that the inner surface and the outer surface are adjacent to one another when overlapped; a first spring positioned along the extension axis in an interior of the outer tube; a second spring positioned along the extension axis in an interior of the inner tube; a seal positioned between the inner surface and the outer surface; and a stopper to engage the first spring at one end and engage the second spring at an opposite end such that the first spring and the second spring are in series with one another along the extension axis; wherein the one end and the opposite end are spaced apart from one another such that the seal is positioned between the one and opposite end.

A second aspect provided is a method for operating an extension mechanism coupled with a closure panel to assist in opening and closing of the closure panel of a vehicle between a fully closed position and a fully open position of the closure panel, the method comprising the steps of: moving an inner tube relative to an outer tube during said opening and closing, the inner tube having an outer surface, the outer tube having an inner surface and overlapping the inner tube for at least a portion of the outer surface along an extension axis, such that the inner surface and the outer surface are adjacent to one another when overlapped, a seal being positioned between the inner surface and the outer surface; expanding or contracting a first spring, the first spring positioned along the extension axis in an interior of the outer tube; expanding or contracting a second spring, the second spring positioned along the extension axis in an interior of the inner tube; and engaging by a stopper the first spring at one end and the second spring at an opposite end such that the first spring and the second spring are in series with one another along the extension axis; wherein the first end and the second end are spaced apart from one another such that the seal is positioned between the first and second end.

In accordance with another aspect, the extension mechanism further includes a first connector connected to the inner tube and a second connector connected to the outer tube, such that one of the first connector and the second connector is for connecting the extension mechanism to a body of the vehicle and the other of the first connector and the second connector is for connecting the extension mechanism to the closure panel.

In accordance with another aspect, there is provided an extension mechanism for coupling with a closure panel to assist in opening and closing of the closure panel of a vehicle between a fully closed position and a fully open position of the closure panel, the extension mechanism including an inner tube having an outer surface, an outer tube having an inner surface and overlapping the inner tube for at least a portion of the outer surface along an extension axis, such that the inner surface and the outer surface are adjacent to one another when overlapped, a first spring positioned along the extension axis in an interior of the outer tube, a second spring positioned along the extension axis in an interior of the inner tube, and a stopper to engage the first spring at one end and engage the second spring at an opposite end such that the first spring and the second spring are in series with one another along the extension axis, wherein the stopper is configured to move during one of an expansion and a compression of at least one of the first spring and the second spring. In accordance with a further aspect, the first spring and the second springs have different outer radial diameters. In accordance with a further aspect, the inner tube and outer tube have different radial diameters.

Other aspects, including methods of operation, and other embodiments of the above aspects will be evident based on the following description and drawings.

BRIEF DESCRIPTION OF THE DRAWINGS

Reference is made, by way of example only, to the attached figures, wherein.

DETAILED DESCRIPTION OF EXAMPLE EMBODIMENTS

Figure 1:
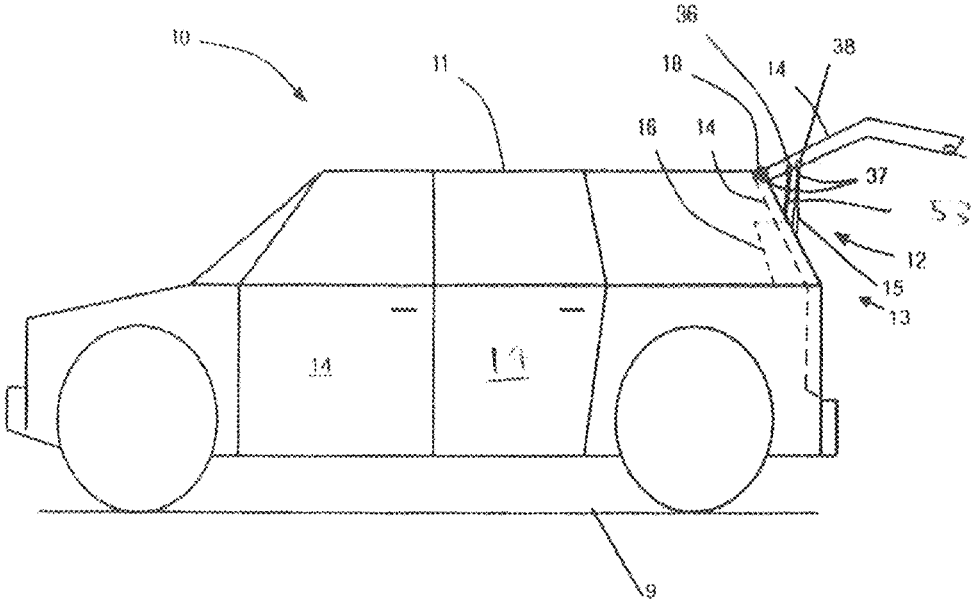
FIG. 1 is a side view of a vehicle with a closure panel assembly.

In this specification and in the claims, the use of the article "a", "an", or "the" in reference to an item is not intended to exclude the possibility of including a plurality of the item in some embodiments. It will be apparent to one skilled in the art in at least some instances in this specification and the attached claims that it would be possible to include a plurality of the item in at least some embodiments. Likewise, use of a plural form in reference to an item is not intended to exclude the possibility of including one of the item in some embodiments. It will be apparent to one skilled in the art in at least some instances in this specification and the attached claims that it would be possible to include one of the item in at least some embodiments. The expression "E.g." is used herein and is understood to stand for exempli gratia in Latin, which means "for example", and is not intended limit the embodiment.

Provided is an actuator or counterbalance mechanism 15 (i.e. extension mechanism—see FIG. 1) that can be used advantageously with vehicle closure panels 14 to provide for open and close modes and/or to provide for operator assistance, as discussed below, in particular for land-based, sea-based and/or air-based vehicles 10. Other applications of the extension mechanism 15, in general for closure panels 14 both in and outside of vehicle applications, include advantageously assisting in optimization of overall hold and manual effort forces for closure panel 14 operation. It is recognized as well that the extension mechanism 15 examples provided below can be used advantageously as the sole means of open and close assistance for closure panels 14 or can be used advantageously in combination (e.g. in tandem) with other closure panel 14 biasing members (e.g. spring loaded hinges, biasing struts, etc.).

In particular, the extension mechanism can be friction assisted via one or more bushings 42 (see FIGS. 7 and 8) and used to provide or otherwise assist in a holding force (or torque) for the closure panel 14, as further described below. Further, it is recognized that the extension mechanism can be integrated with a biasing member 37 (see FIG. 1) such as a spring loaded strut and/or provided as a component of a closure panel assembly, as further described below. It is recognized that the biasing member 37, incorporating the extension mechanism 15, can be implemented as a strut, biased via a plurality (e.g. two or more) springs 20 positioned in series along an extension axis 21 of the extension mechanism 15 (see FIG. 7).

Referring to FIG. 1, shown is the vehicle 10 with a vehicle body 11 having one or more closure panels 14. One example configuration of the closure panel 14 is a closure panel assembly 12 including the extension mechanism 15 (e.g. incorporated in a biasing member 37 embodied as a strut by example) and a closure panel drive system 16 (e.g. incorporating an electrically powered motor/drive). For vehicles 10, the closure panel 14 can be referred to as a partition or door, typically hinged, but sometimes attached by other mechanisms such as tracks, in front of an opening 13 which is used for entering and exiting the vehicle 10 interior by people and/or cargo. It is also recognized that the closure panel 14 can be used as an access panel for vehicle 10 systems such as engine compartments and also for traditional trunk compartments of automotive type vehicles 10. The closure panel 14 can be opened to provide access to the opening 13, or closed to secure or otherwise restrict access to the opening 13. It is also recognized that there can be one or more intermediate hold positions of the closure panel 14 (assisted via the bushings 42 as well as the springs 20) between a fully open position and fully closed position, as provided at least in part by the extension mechanism 15 as further described below. For example, the extension mechanism 15 can assist in biasing movement of the closure panel 14 away from one or more intermediate hold position(s), also known as Third Position Hold(s) (TPHs) or Stop-N-Hold(s), once positioned therein. It is also recognized that the extension mechanism 15 can be provided as a component of the closure panel assembly 12, such that the extension mechanism 15 component can be separate from the one or more biasing struts 37.

The closure panel 14 can be opened manually and/or powered electronically via the closure panel drive system 16, where powered closure panels 14 can be found on minivans, high-end cars, or sport utility vehicles (SUVs) and the like. Additionally, one characteristic of the closure panel 14 is that due to the weight of materials used in manufacture of the closure panel 14, some form of force assisted open and close mechanism (or mechanisms) are used to facilitate operation of the open and close operation by an operator (e.g. vehicle driver) of the closure panel 14. The force assisted open and close mechanism(s) can be provided by the extension mechanism 15, any biasing members 37 (e.g. spring loaded hinges, spring loaded struts, gas loaded struts, electromechanical struts, etc.) and the closure panel drive system 16 when used as part of the closure panel assembly 12, such that the extension mechanism 15 is configured to provide a friction based holding torque (or force) to supplement the spring forces that acts against the weight of the closure panel 14 on at least a portion of the panel open/close path about the third position hold, in order to help maintain the position of the closure panel 14 about the third position hold. The ability to provide the desired hold friction within the extension mechanism can be facilitated by one or more of the bushings 42 and springs 20.

Figure 5:
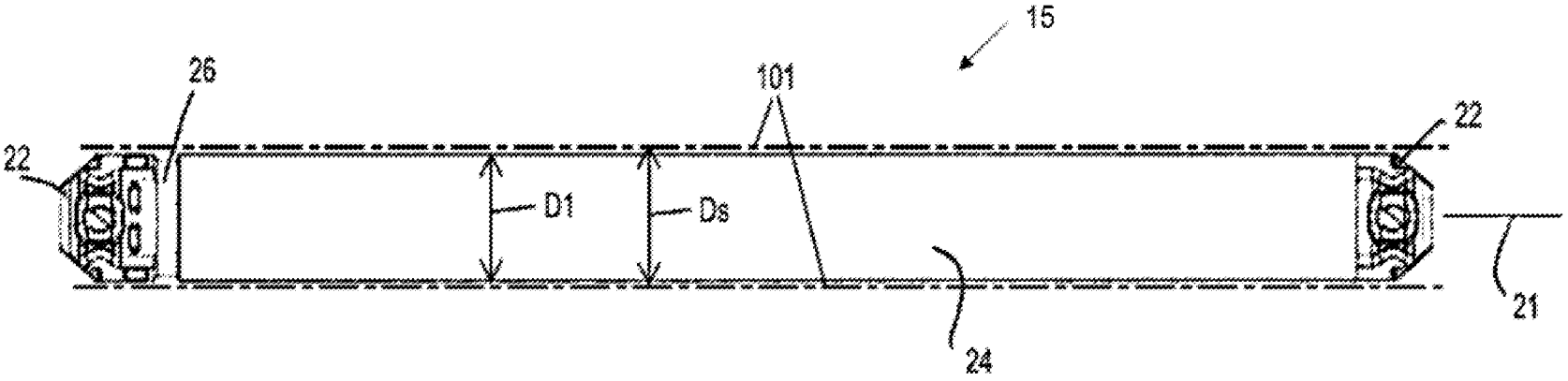
FIG. 5 shows a side plan view of the extension mechanism of FIG. 1 in a retracted configuration.
Figure 5A:
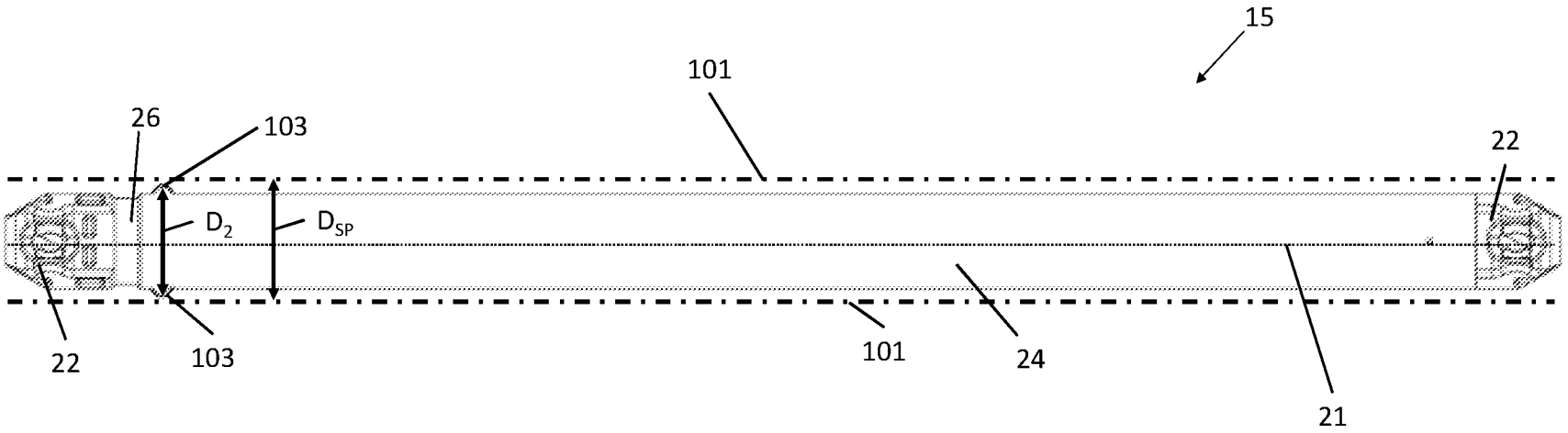
FIG. 5A (Prior Art)
FIG. 5A shows a side plan view of a prior art extension mechanism of in a retracted configuration.
Figure 6:
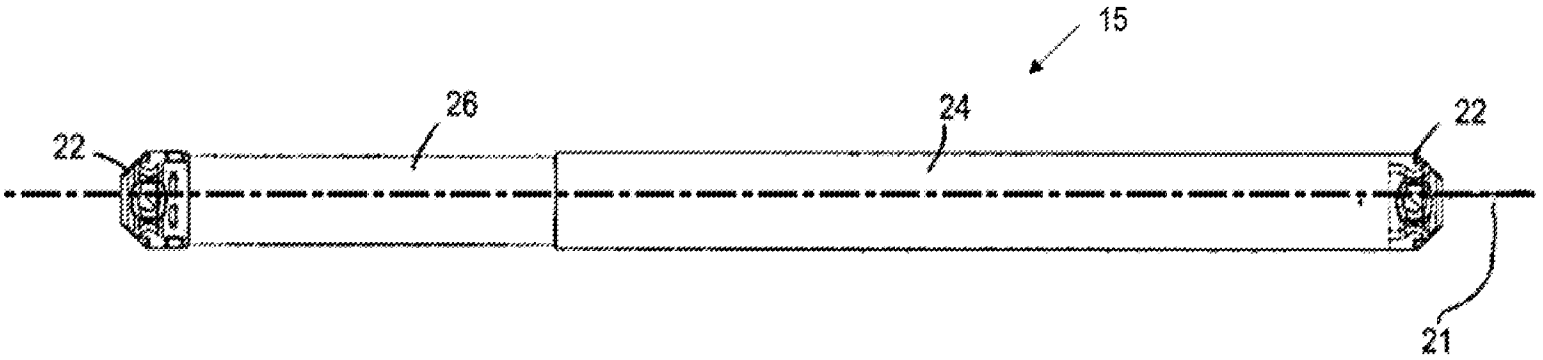
FIG. 6 shows a side plan view of the extension mechanism of FIG. 1 in an extended configuration.
Figure 7:
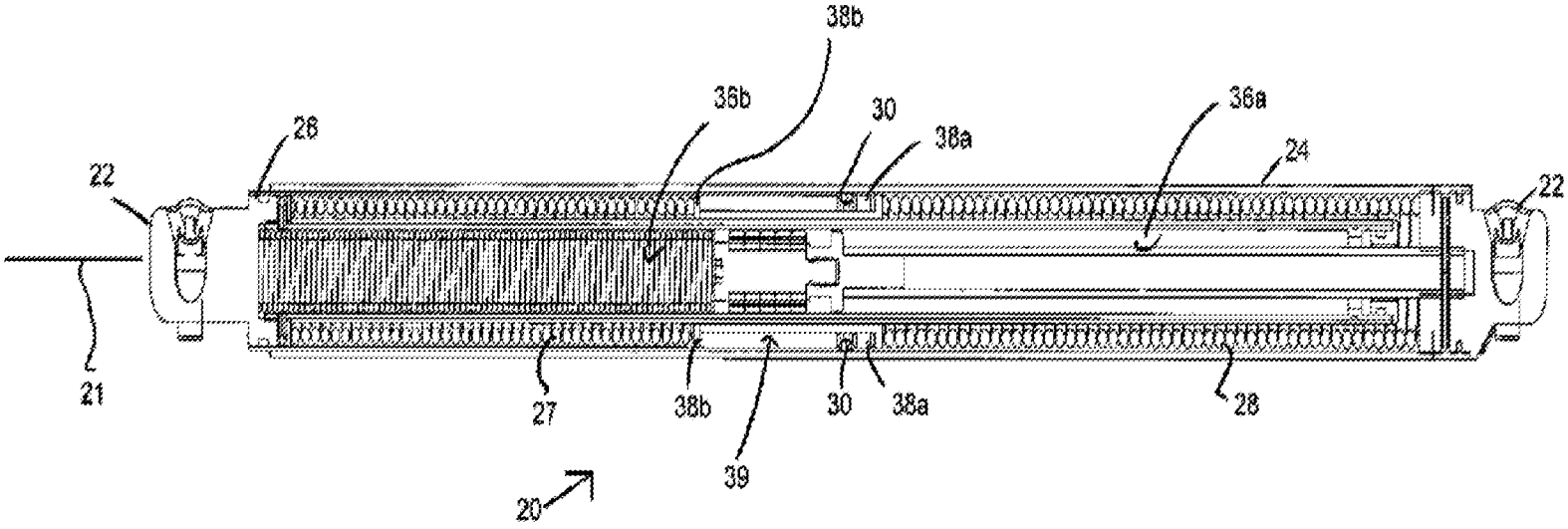
FIG. 7 shows a cross sectional view of a further embodiment of the extension mechanism of FIG. 1 in a retracted configuration.
Figure 8:
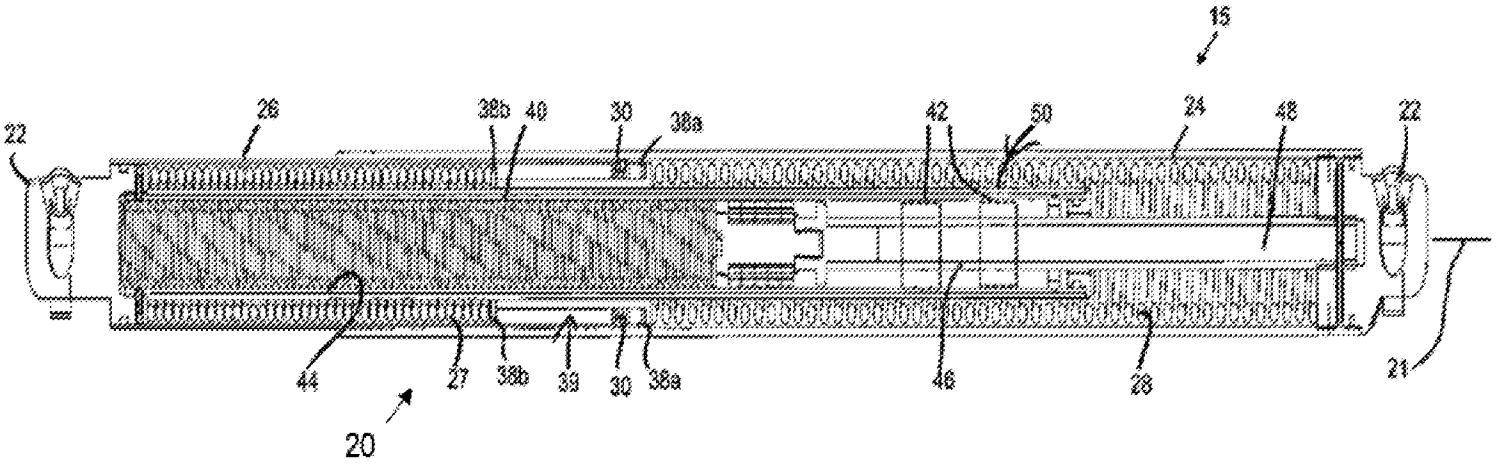
FIG. 8 shows a cross sectional view of the further embodiment of the extension mechanism of FIG. 7 in an extended configuration.

Referring to FIGS. 5 and 6, the extension mechanism 15 relates to a telescoping tube configuration with multiple springs 20 (see FIGS. 7 and 8) positioned in series along an extension axis 21 of the extension mechanism 15. The extension mechanism 15 has connectors 22 (e.g. ball sockets) at either end for connecting to a vehicle body 11 at one end and the closure panel 14 at the other end. Provided are an outer tube 24 (e.g. a spring cover tube) that telescopes along the extension axis 21 with respect to an inner tube 26 (e.g. a housing tube). Outer tube 24 is illustratively shown as having a constant diameter $D_1$ over its length without having any humps, bumps or protrusions of the like extending outwardly from the outer surface of the outer tube 24 provided to accommodate any seals or crimps or connections, which would increase the maximum outer diameter of the outer tube 24 and require an increase in surrounding packaging (e.g. a stow area 101 provided for in the vehicle body 11, the closure panel 14, inner paneling, or the like compartments). Stow area 101 is illustratively shown in phantom lines having an inner diameter $D_s$ slightly larger than $D_1$ over the length of the stow area 101 to receive part of or all of the outer tube 24. With reference to FIG. 5A illustrating a known configuration, inner diameter $D_{SP}$ is larger than $D_2$ being an outer diameter of the and larger than $D_S$ to accommodate for any such humps, bumps or protrusions 103 extending to the outer bounds having a diameter $D_2$, where $D_2$ is greater than $D_1$. FIG. 5 shows the extension mechanism 15 in a retracted configuration and FIG. 6 shows the extension mechanism 15 in an extended configuration. Concerning FIGS. 7 and 8, shown are the springs 20 (e.g. a second spring 27 and a first spring 28) which are distributed adjacent to one another in series along the extension axis 21.

Figure 9:
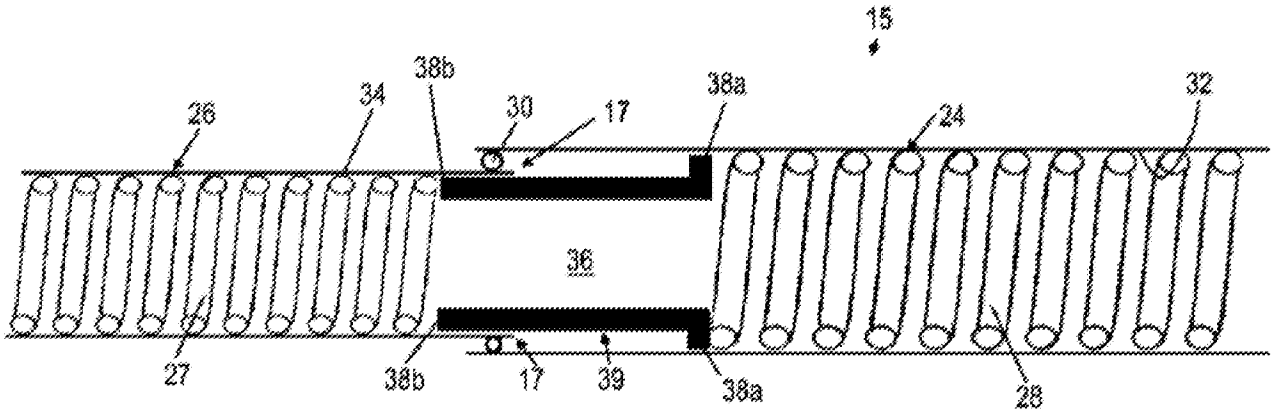
FIG. 9 shows a cross sectional view extension mechanism of FIG. 1.

Referring to FIG. 9, there is situated a seal 30 between an inner surface 32 of the outer tube 24 and an outer surface 34 of the inner tube 26, such that the seal 30 is used to inhibit the intrusion of foreign matter (e.g. dirt, moisture) from the exterior environment into an interior 36*a,b* of the extension mechanism 15. Seal 30 may be a rubber O-ring seal as but one illustrative example. Also provided is one or more stops 38*a,b* positioned adjacent the inner surface 32, which retain the first spring 28 within the outer tube 24 and away from the position of the seal(s) 30. It is recognized that the seal 30 and one or more of the stop(s) 38*a,b* can be positioned adjacent to one another and between the second spring 27 and the first spring 28. For example, the seal(s) 30 can be connected to the outer surface 34, such that during extension of the extension mechanism 15 the separation distance (along the extension axis 21) increases between the one or more of the stop(s) 38*a,b* and the seal(s) 30, while during retraction of the extension mechanism 15 the separation distance (along the extension axis 21) decreases between the one or more stop(s) 38*a,b* and the seal(s) 30. Alternatively, the seal(s) 30 can be mounted to a stopper 39 (see FIG. 9*a*).

Referring again to FIGS. 7 and 8, the extension mechanism 15 can also have a support tube 40 positioned along the extension axis 21 in the interior 36*b* for maintaining alignment of the inner and outer tubes 24,26 with one another during operation (i.e. extension/retraction). Optionally, the extension mechanism 15 can have one or more friction elements 42, e.g. bushings, in order to introduce friction to the operation of the extension mechanism 15 to assist in the stop and hold operations as described. For example, the friction elements 42 can slide along an inner surface 44 of the support tube 40 and/or an outer surface 46 of a shaft 48 (positioned along the extension axis 21) during operation of the extension mechanism 15. Sleeves 41 can be provided to facilitate smooth extension/retraction of the springs 27,28 with respect to the adjacent surfaces (e.g. surfaces 32,34—see FIG. 9) of the inner and outer tubes 24,26.

In terms of vehicles 10, the closure panel 14 may be a lift gate 14 as shown in FIG. 1, or it may be some other kind of closure panel 14, such as an upward-swinging vehicle door (i.e. what is sometimes referred to as a gull-wing door) or a conventional type of door that is hinged at a front-facing or back-facing edge of the door, and so allows the door to swing (or slide) away from (or towards) the opening 13 in the body 11 of the vehicle 10. Also contemplated are sliding door embodiments of the closure panel 14 and canopy door embodiments of the closure panel 14, such that sliding doors can be a type of door that open by sliding horizontally or vertically, whereby the door is either mounted on, or suspended from a track that provides for a larger opening 13 for equipment to be loaded and unloaded through the opening 13 without obstructing access. Canopy doors are a type of door that sits on top of the vehicle 10 and lifts up in some way, to provide access for vehicle passengers via the opening 13 (e.g. car canopy, aircraft canopy, etc.). Canopy doors can be connected (e.g. hinged at a defined pivot axis and/or connected for travel along a track) to the body 11 of the vehicle at the front, side or back of the door, as the application permits.

Referring again to FIG. 1, in the context of a vehicle application of a closure panel by example only, the closure panel 14 is movable between a closed position (shown in dashed outline) and an open position (shown in solid outline). In the embodiment shown, the closure panel 14 pivots between the open position and the closed position about a pivot axis 18, which is preferably configured as horizontal or otherwise parallel to a support surface 9 of the vehicle 10. In other embodiments, the pivot axis 18 may have some other orientation such as vertical or otherwise extending at an angle outwards from the support surface 9 of the vehicle 10. In still other embodiments, the closure panel 14 may move in a manner other than pivoting, for example, the closure panel 14 may translate along a predefined track or may undergo a combination of translation and rotation between the open and closed position.

Figure 2:
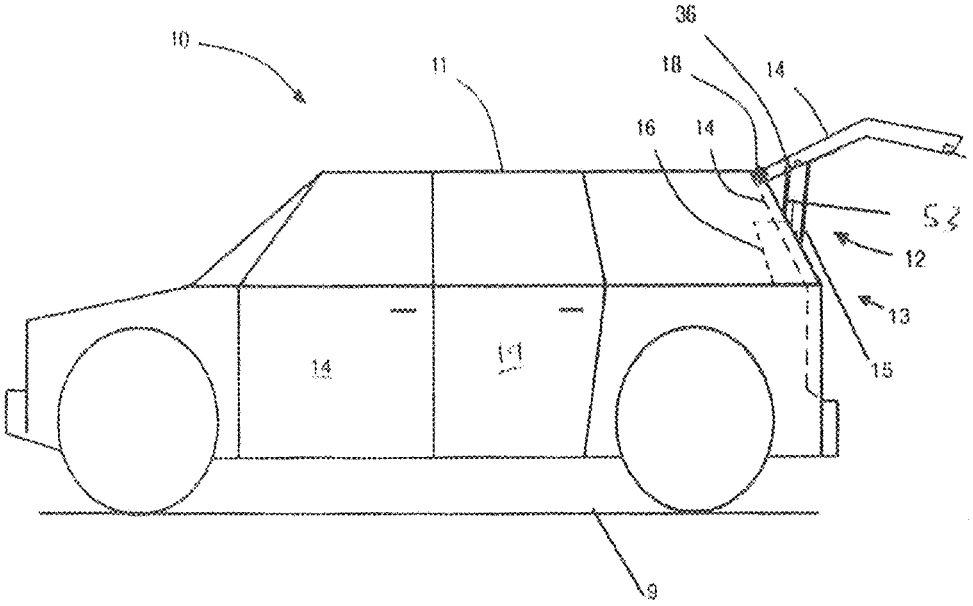
FIG. 2 is an alternative embodiment of the vehicle of FIG. 1.

Referring again to FIG. 1, as discussed above, the extension mechanism 15 examples provided below for the closure panel assembly 12 can be used as the sole means of open and close assistance for the inhibition of sag by the closure panels 14 themselves (see FIG. 2), or can be used in combination (e.g. in tandem or otherwise integrated) with one or more other closure panel biasing members 37 (e.g. spring loaded hinges, struts such as gas struts or spring loaded struts, etc.) that provide a primary connection of the closure panel 14 to the vehicle body 11 at a pivot connection 18, 138 (see FIG. 1). In general operation of the closure panel 14, the closure panel drive system 16 can be coupled to a distal end of the shaft 53 (also referred to as lever mechanism or arm or element) used to connect the closure panel 14 as a secondary connection of the closure panel to the vehicle body 11, such that the closure panel biasing member 37 and the shaft 53 can be pivotally attached to the closure panel 14 at spaced apart locations as shown. In this manner, the other end (e.g. proximal end) of the shaft 53 pivotally can connect to the closure panel 14 at pivot connection 36. It is recognized that the shaft 53 itself can be configured as a non-biasing element (e.g. a solid/hollow rod) or can be configured as part of a biasing element (e.g. a gas or spring assisted extension strut), as desired. It is also recognized that the shaft 53 can be exposed as shown or contained (see FIG. 8 as indicated shaft 48 embodiment) within the interior 36*a,b*, as desired.

Referring again to FIG. 1, one or more optional closure panel biasing members 37 can be provided which urge the closure panel 14 towards the open position throughout at least some portion of the path between the open position and the closed position and which assist in holding the closure panel 14 in the open position (assisted via the bushings 42). The closure panel biasing members 37 can be, for example, gas extension struts which are pivotally connected at their proximal end to the closure panel 14 and at their distal end to the vehicle body 11. In the embodiment shown, there are two biasing members 37 (one on the left side of the vehicle 10 and one on the right side of the vehicle 10), however one biasing member 37 is obscured by the other in the view shown. 10.

Recognizing the role of the optional bushing(s) 42 and the series of springs 20, as the closure panel 14 moves between the open and closed positions, the torques (or forces) exerted on the closure panel 14 by the biasing members 37 and by the weight of the closure panel 14 itself will vary. In one embodiment, the closure panel 14 can have some position between the open and closed positions at which the torque (or force) exerted on the closure panel 14 by the biasing members 37 cancels out the torque (or force) exerted on the closure panel 14 by the weight of the closure panel 14 (i.e. the torque or force of the biasing member(s) 37 acts against the weight of the closure panel 14). Above this point (which can be referred to as a balance point or otherwise referred to as the intermediate hold position), the torque (or force) exerted by the biasing members 37 can overcome the torque (or force) exerted by the weight of the panel 14 thus resulting in a net torque (or force) away from the closed position, thus biasing the closure panel 14 towards the open position (i.e. the torque or force of the biasing member(s) 37 acts against the weight of the closure panel 14). Below this point, the torque (or force) exerted by the weight of the panel 14 can overcome the torque (or force) exerted by the biasing members 37 thus resulting in a net torque (or force) towards the closed position, thus biasing the closure panel 14 towards the closed position. However, even in travel of the closure panel 14 towards the closed position, the torque or force of the biasing member(s) 37 acts against the weight of the closure panel 14. In this manner, the effect of the biasing member(s) 37 is to provide a torque or force that always acts against the weight of the closure panel 14 (i.e. always supplies an opening torque or force). It is recognized that "3rd position hold" can also be referred to as an "intermediate hold position" or a "stop and hold position".

Figure 3:
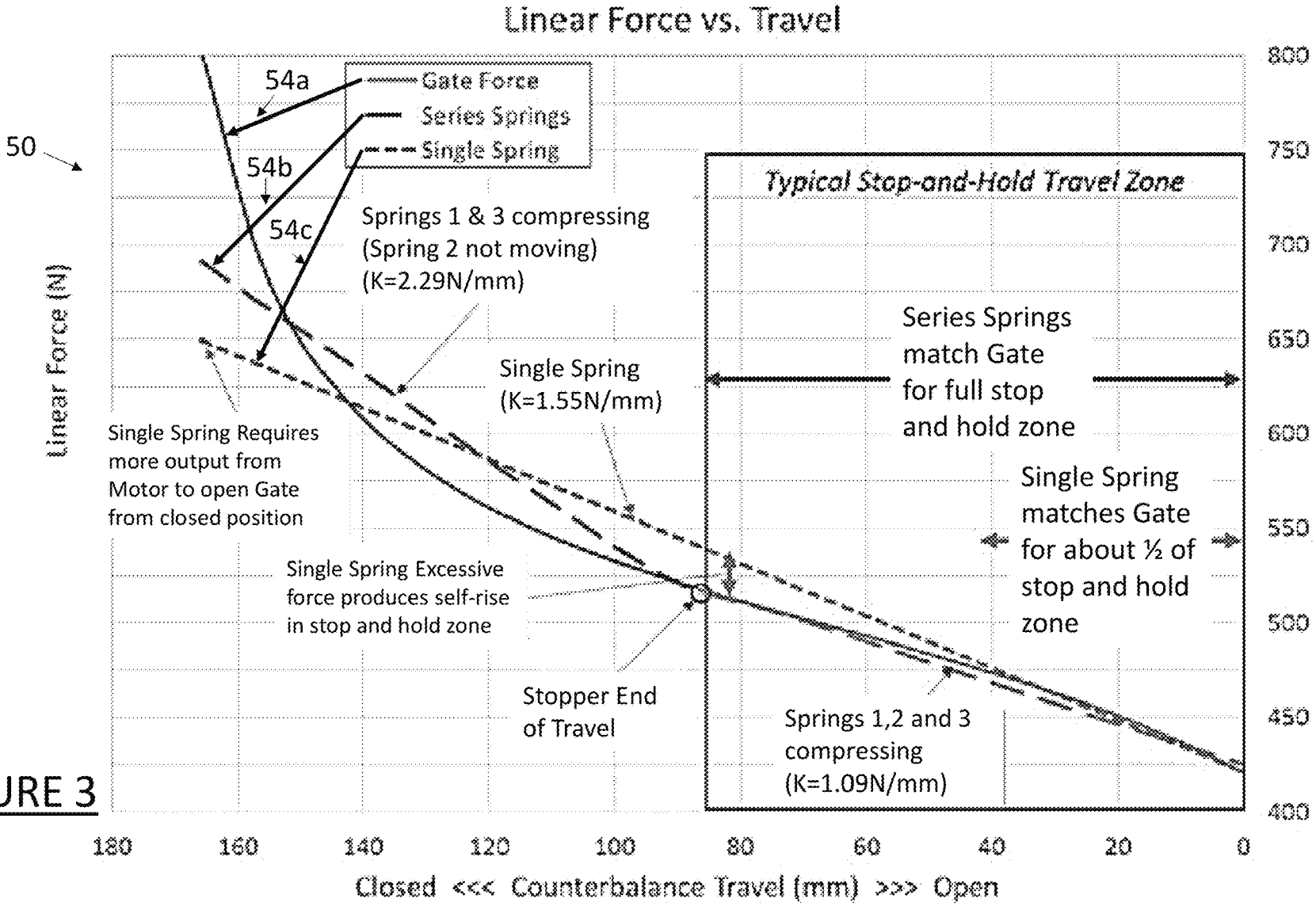
FIG. 3 shows example linear force vs. travel for an extension mechanism of FIG. 1.
Figure 4:
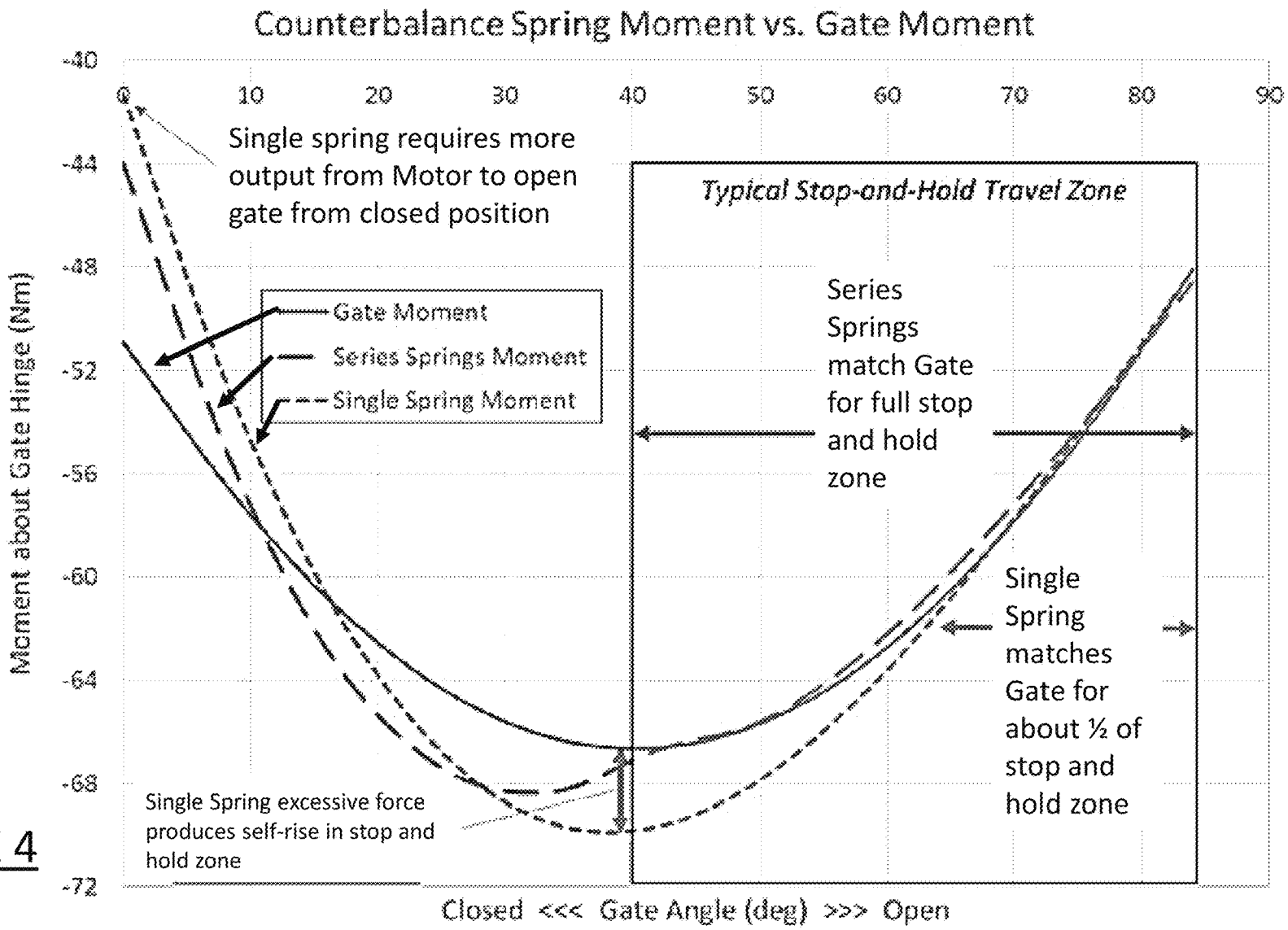
FIG. 4 shows example moment force vs. angle for the extension mechanism of FIG. 1.

Referring to FIGS. 3 and 4, Lift Gate Load Curves 50, 52 are shown, providing an example load curve 54*a* of the lift gate 14 to show the relationship of linear force verses travel. Also shown is a load curve 54*c* of a prior art counterbalance having a single spring. It is recognized that the closer the load curve 54*a* matches the counterbalance curve 54*b,c*, the more balanced the system is, which is more desirable. The new counterbalance provided by the extension mechanism 15 of FIGS. 7 and 8 has the load curve 54*b*, noting how the load curve 54*b* (representing the influence of the springs 20 in series) more closely matches the load curve 54*a* of the lift gate 14. As such, it is recognized that the provision of the (e.g. pair of) springs 20 in series in the telescoping tube arrangement (i.e. overlapping inner tube 26 and outer tube 24) for the counterbalance system, as embodied in the extension mechanism 15 by example, contributes to a better matched counterbalance curve 54*b* over that of the single spring prior art example curve 54*c*.

Further, referring again to FIGS. 7,8,9, the inclusion of the seal 30 between the inner tube 26 and the outer tube 24 improves packaging of the counterbalance i.e. a strut having a constant outer diameter over its length along the extension axis 21. Further, the inclusion of the pair of springs 20 in series, as separated by the seal 30 and stops 38*a,b* there between, provides for a counterbalance that more closely matches the load curve 54*a* (i.e. provides a kick at the beginning of opening of the extension mechanism 15 utilizing the first spring 28 and provides better matching in the stop and hold zone when utilizing the second spring 27).

Therefore, it is recognized that the two or more springs 20 operate in series in the Stop-and-Hold zone in order to provide a flatter spring rate for optimal balance of the lift gate 14. In the Close/retraction direction, the second spring 27 bottoms out when the end 17 of the inner tube 26 contacts the Stop 38 at a mid-travel point and then the first spring 28 is the only active spring 20 in the extension mechanism 15. The spring rate of the first spring 28 on its own can be steeper in order to better assist the opening of the lift gate 14 in the first ⅓ to ½ of travel extension, as shown in the graphs 50,52 (see FIGS. 3 and 4).

Further, referring again to FIGS. 7,8,9, the provision of the stop(s) 38 and the springs 20 in series also provide a means of using the space on either side of a seal 30 feature for springs 27,28 (i.e. spring coils) in order to better optimize the lift gate 14 balance while allowing room for adequate sealing via the seal(s) 30. As such, the provision of the seal(s) 30 between the inner and outer tubes 24, 26 can improve the seal design so that the seal hump 103 (of the prior art) is eliminated and the diameter of the counterbalance can be appropriately reduced. The stop(s) 38 can be incorporated to bypass the now inwardly projecting seal(s) 30. At the same time this stop 38 interconnects the two springs 20 in the series arrangement in a manner as illustratively now described.

Figure 9A:
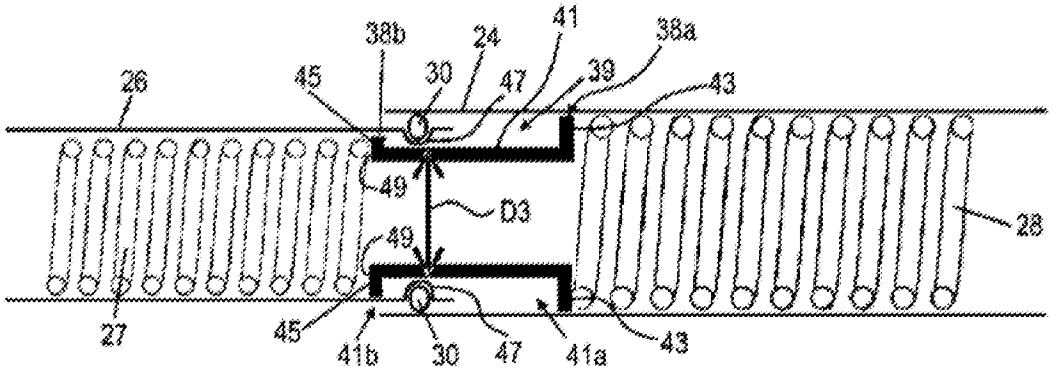
FIG. 9A shows a cross sectional view extension mechanism of FIG. 1, in accordance with an illustrative embodiment.
Figure 9B:
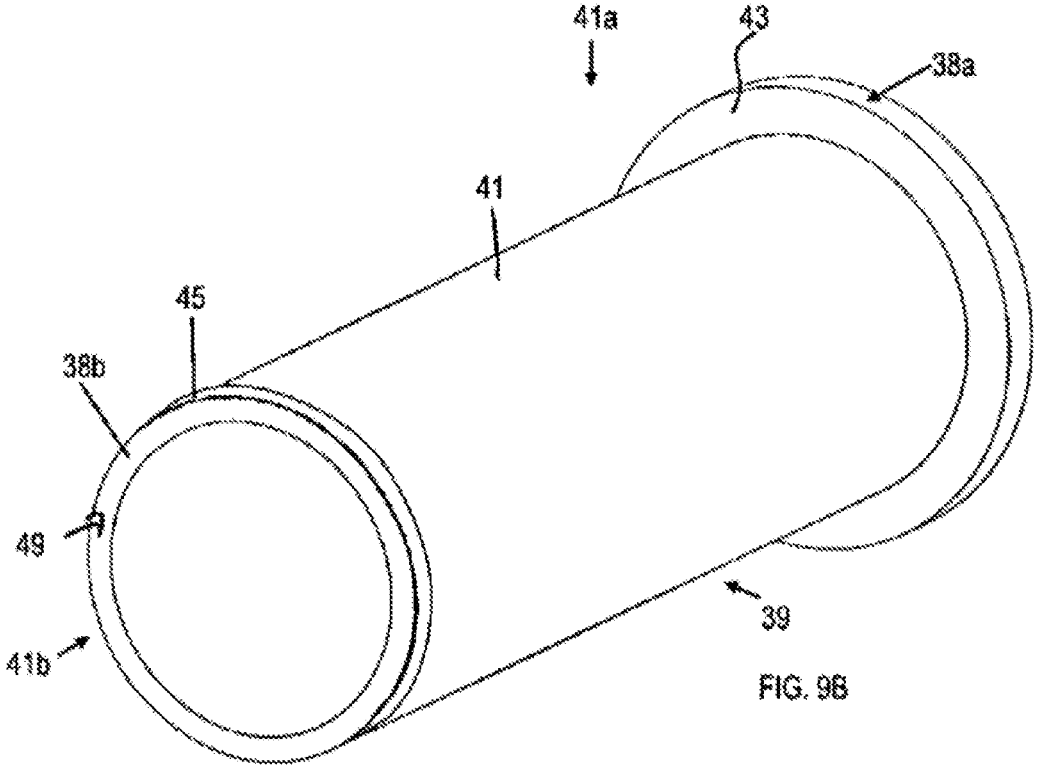
FIG. 9B shows a perspective view of a stopper of the extension mechanism of FIG. 9A, in accordance with an illustrative embodiment.
Figure 10A:
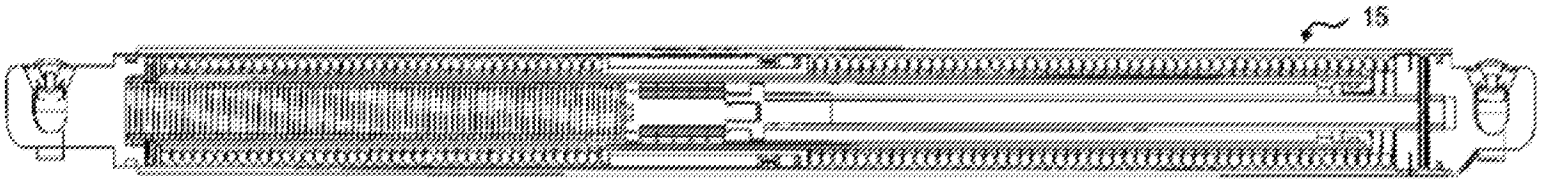
FIGS. 10*a*, 10*b*, 10*c* show cross sectional views of a still further embodiment of the extension mechanism of FIG. 1 in retracted and extended configurations.
Figure 10B:
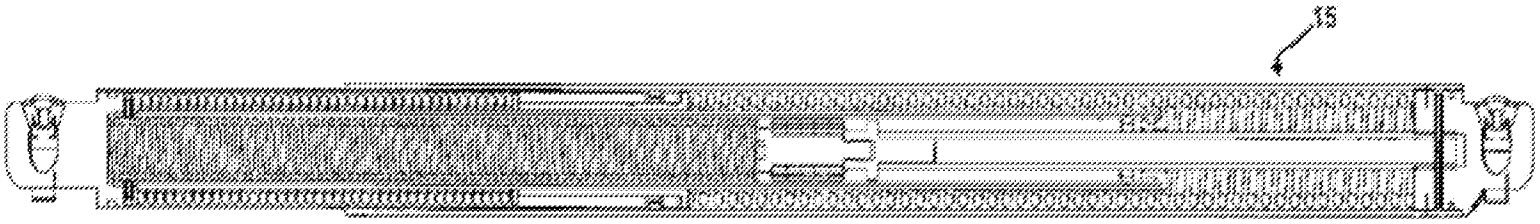
Figure 10C:
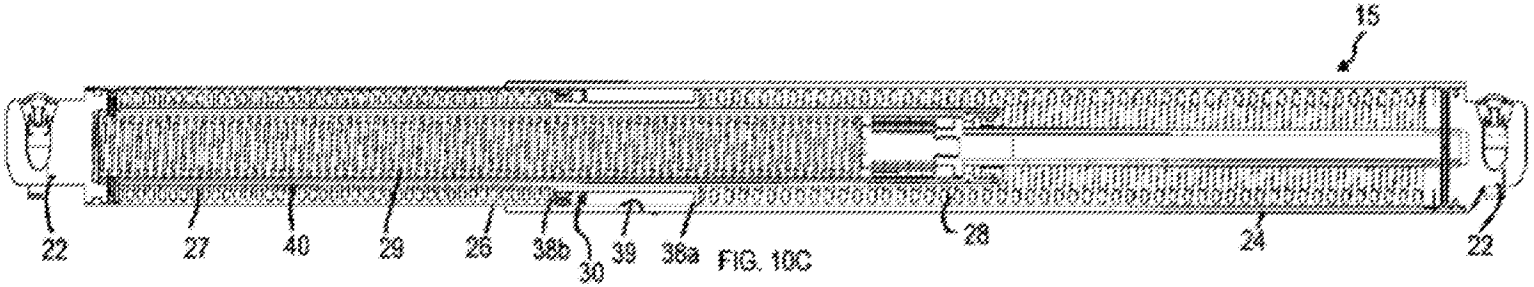
Figure 10D:
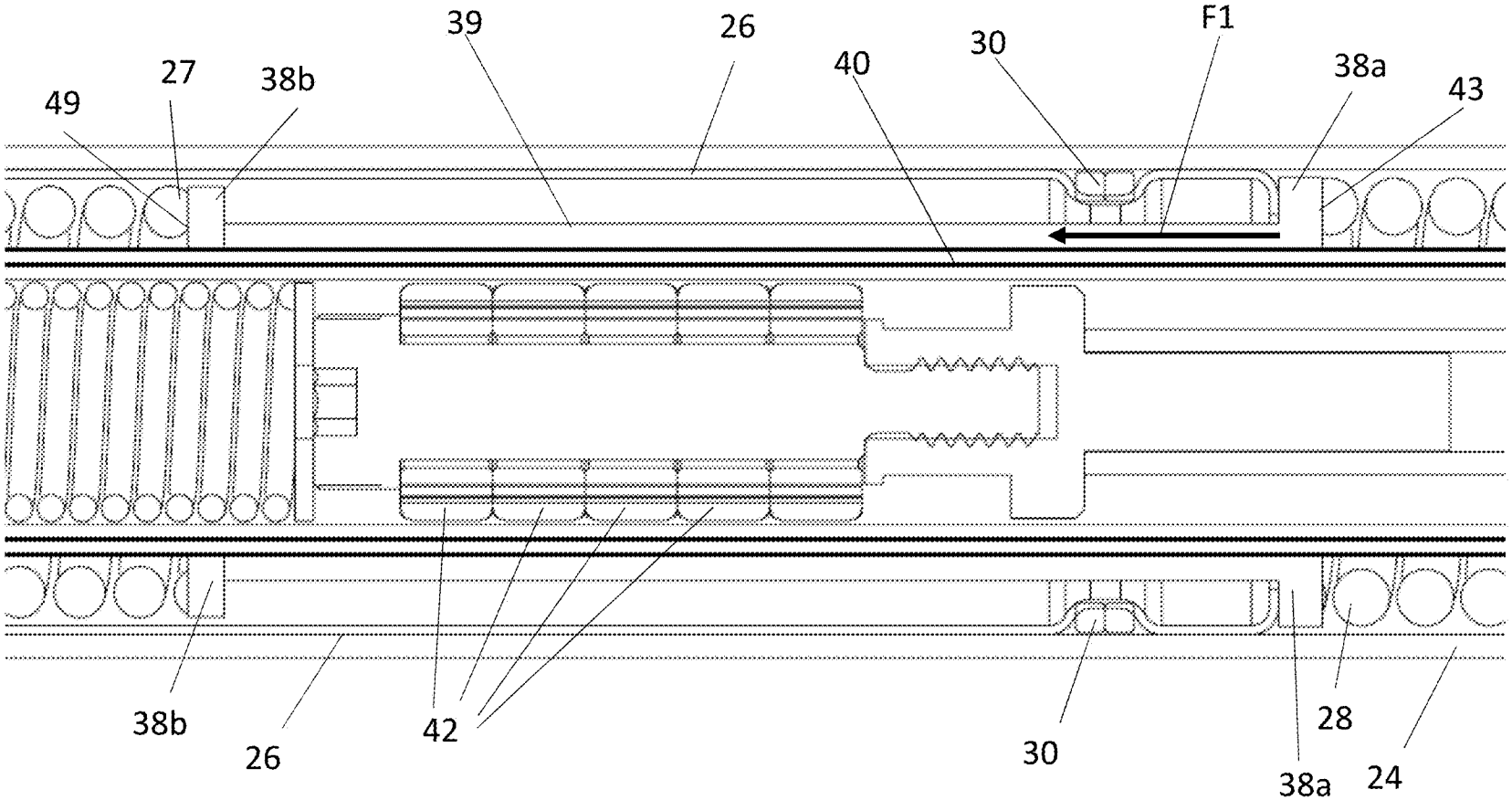
FIGS. 10*d*, 10*e*, 10*f* show enlarged partial cross sectional views of respective FIGS. 10*a*, 10*b*, and 10*c*.
Figure 10E:
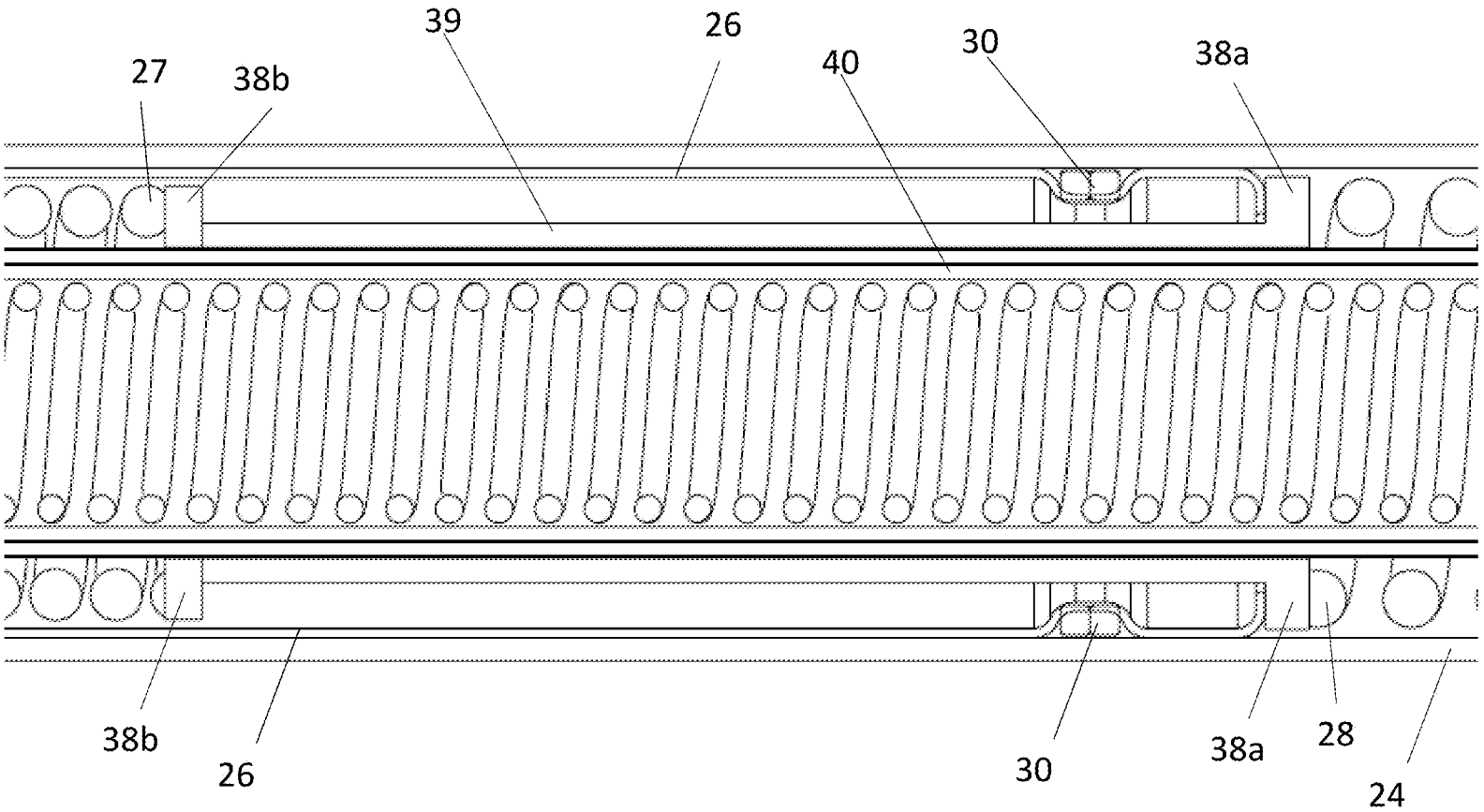
Figure 10F:
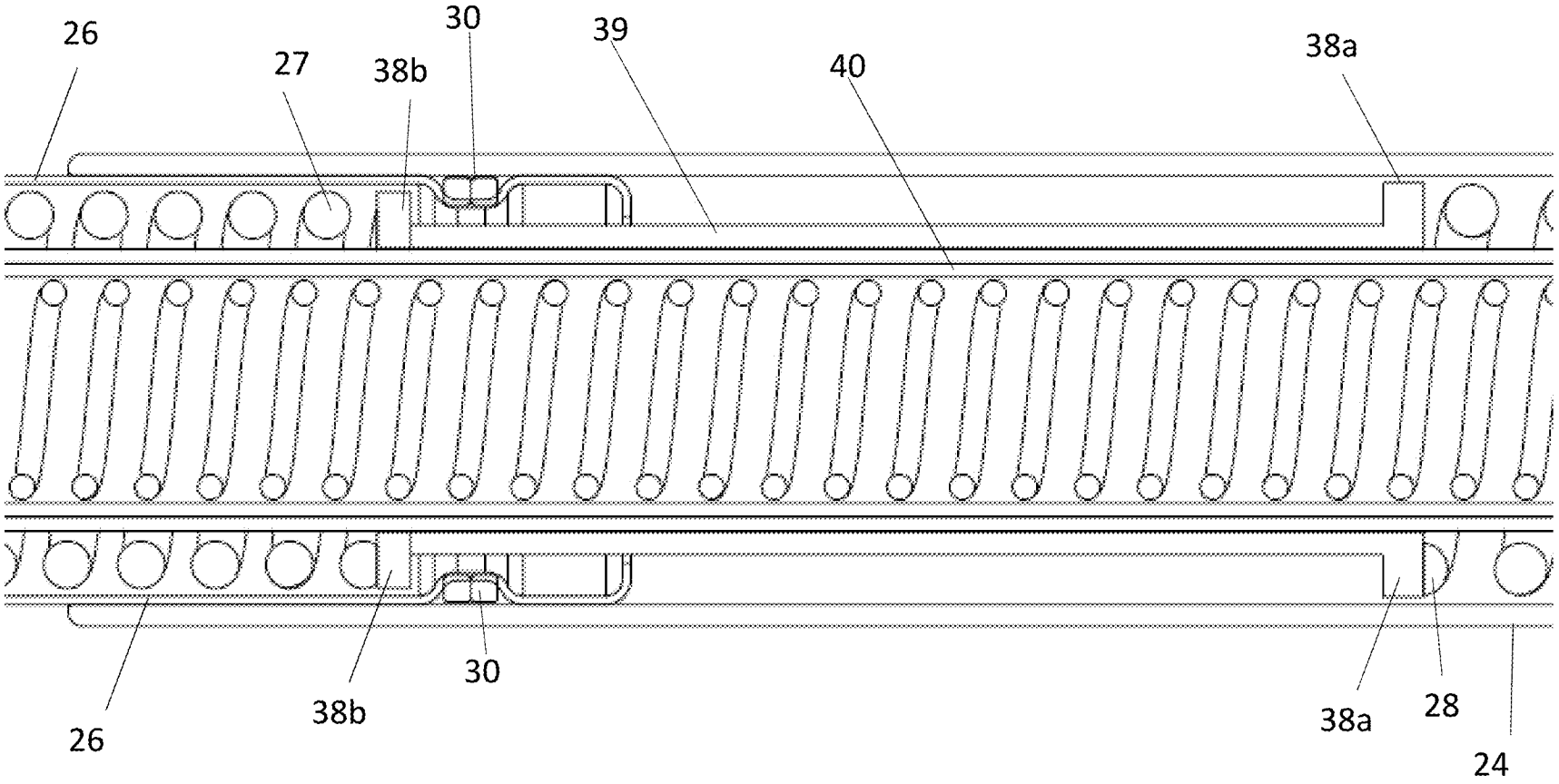

Illustratively with reference to FIGS. 9, 9A, and 9B, the stop(s) 38 form part of a stopper 39 interconnecting or bridging the first spring 28 and the second spring 27 in series relationship. The stop(s) 38*a,b* illustratively formed as a circumferential member, having a first diameter configured to allow abutment of the first spring 28 of similar diameter there against (illustratively shown in FIG. 10*d*). The stopper 39 further includes an interconnecting sleeve 41 having at one end 41*a* the stop 38*a* and being slideably received within the inner tube 26 to abut the second spring 27 at an opposite end 41*b* via the stop 38*b* (illustratively shown in FIG. 10*d*). For example, stopper 39 is configured to move during expansion of the first spring 28 to move the stop 38*a* and correspondingly move the second spring 27 during or before expansion of the first spring 28. Similarly, the stopper 39 is configured to move during compression of the first spring 28 resulting from movement of the stop 38*b* by the compressing of second spring 27. Stopper 39 may be configured to move during expansion or compression of either or both (for example simultaneously) of the first spring 28 and the second spring 27. At the interconnecting sleeve's 41 first end 41*a*, the diameter is such so as to provide a first abutting surface 43 (e.g. as part of the stop 38*a* provided as an upstanding lip) to engage with the first spring 28. Further, at the interconnecting sleeve's 41 opposite end 41*b*, a second abutting surface 45 (e.g. as part of the stop 38*b* provided as an upstanding lip) can be provided so as to provide a hard stop feature engageable with an abutment feature 47 extending inwardly from the inner tube 26, which may also be provided as a depression (e.g. abutment feature 47) in the inner tube 26 to also accommodate the seal(s) 30. Inwardly projecting abutment features 47 illustratively create a bottle neck diameter in the interior of inner tube 26 referred to as $D_3$. The second abutment surface 45 can also provide a contact 49 to engage with the second spring 27. The difference in diameters of the stopper 39 between its one end 41*a* and opposite 41*b* facilitates the interconnection or bridging of the springs 27,28 of different diameters in a series relationship in order to bypass any interference the seal(s) 30 may cause to the travel of a spring having a diameter similar to that of the first spring 28 and without requiring a reduction its diameter. In an embodiment, the sleeve 41 is a hollow tube and the first and second abutting surfaces 43,45 are ring like structures connected to the sleeve 41 at its ends 41*a*, 41*b*. The length of the sleeve 41, and thus the distance between the abutting surface 43,45, (along the extension axis 21) can be designed so as to control where the second spring 27 will stop (hard stop) influencing the counterbalance curve 54*b*. As can be seen, one advantage of extension mechanism 15 as described is that the spring 20 dimensions can be improved to more closely match the load curve 54*a*, for example the first spring 28 can have a larger diameter since it does not extend past the seal 30 and therefore does not have to be limited in diameter to the inner tube's 26 diameter. As a result, two or more springs 20 in series can better influence the spring curve (see graphs 50, 52 of FIGS. 3 and 4) in the stop and hold zone. For example, in an exemplary operation of a movement of the closure panel 14 from a closed position towards an open position, first spring 27 having a larger spring force for example as a result of having a larger radial diameter is able to expand to overcome the closure panel 14 load to force the stopper 39 to move away from Ball connector 22 (i.e. Ball Socket 1) in a direction represented by arrow F1 in FIGS. 10*a*, 10*d*, with second spring 28 remaining compressed, or simultaneously expanding due to its smaller spring force due to, for example, its smaller radial diameter being less than the radial diameter of first spring 27, and greater closure panel 14 load about the initial opening position. At a position of the closure panel 14 depending on the load dynamics of the closure panel 14 as illustratively shown in FIG. 3, second spring 28 begins to expand (for example illustrated in FIGS. 10*b*, 10*e*). At an end of travel of the stopper 39 as dependent on the first spring 27 force characteristics as illustrated in FIG. 3, first spring 27 is prevented from further expansion as a result of stopper 39 abutting with inner tube 26 as illustratively shown in FIGS. 10*c* and 10*f*. Continued expansion of second spring 28 acting against the stopper 39 positioned at the end of travel acts to further move Ball connector 22 (i.e. Ball Socket 1) away from Ball connector 22 (i.e. Ball Socket 2) to thereby move the closure panel 14 towards the open position.

Referring to FIG. 10, shown is a further embodiment of the extension mechanism 15 with a third spring 29 situated in the interior of the support tube 40. In operation of the extension mechanism 15, referring to FIG. 10, the stop(s) 38*a,b* provide a means of interconnecting the springs 27, 28 and bypassing the seal 30 positioned in the inner tube 26 while transmitting load between the first spring 28 and the second spring 27. As a result, each of the outer diameters of springs 27, 28 may be maximized radially outwardly towards the inner surfaces of the inner tube 26 and the outer tube 24 each respectively positioned therein without being limited to a spring outer diameter limited by the inner diameter $D_3$ created by the inwardly projecting depression (e.g. abutment feature 47) in the inner tube 26 to accommodate the seal(s) 30. In other words, the stopper 39 provides for a series connection between springs 27, 28 of different radial extends without being limited to select the smaller diameter for one of the springs 27, 28 to bypass a bottle neck such as feature 47, or by a mismatch or difference in diameters between overlapping tubes 24, 26. In the Closing/retraction direction, in the Stop-and-Hold Zone, Ball connector 22 (i.e. Ball Socket 1) exerts force on the first spring 28 which exerts force on the stop 38*a* which exerts force on the second spring 27 which exerts force on the other connector 22 (i.e. Ball Socket 2). In this zone, the springs 20 (i.e. the first spring 28 and the second spring 27) are acting in series. At mid-travel, the stop 38*b* bottoms out on the end of the inner tube 26. As the Counterbalance provided by the extension mechanism 15 continues to compress, the second spring 27 is no longer compressing. In addition to the first and second springs 27, 28, the third spring 29 is compressing throughout the entire travel (i.e. contraction/retraction of the extension mechanism 15). The connector 22 (i.e. Ball Socket 1) can be rigidly attached to the shaft 48, which exerts a force on the third spring 29 which exerts a force on the other connector 22 (i.e. Ball Socket 2).

Figure 11:
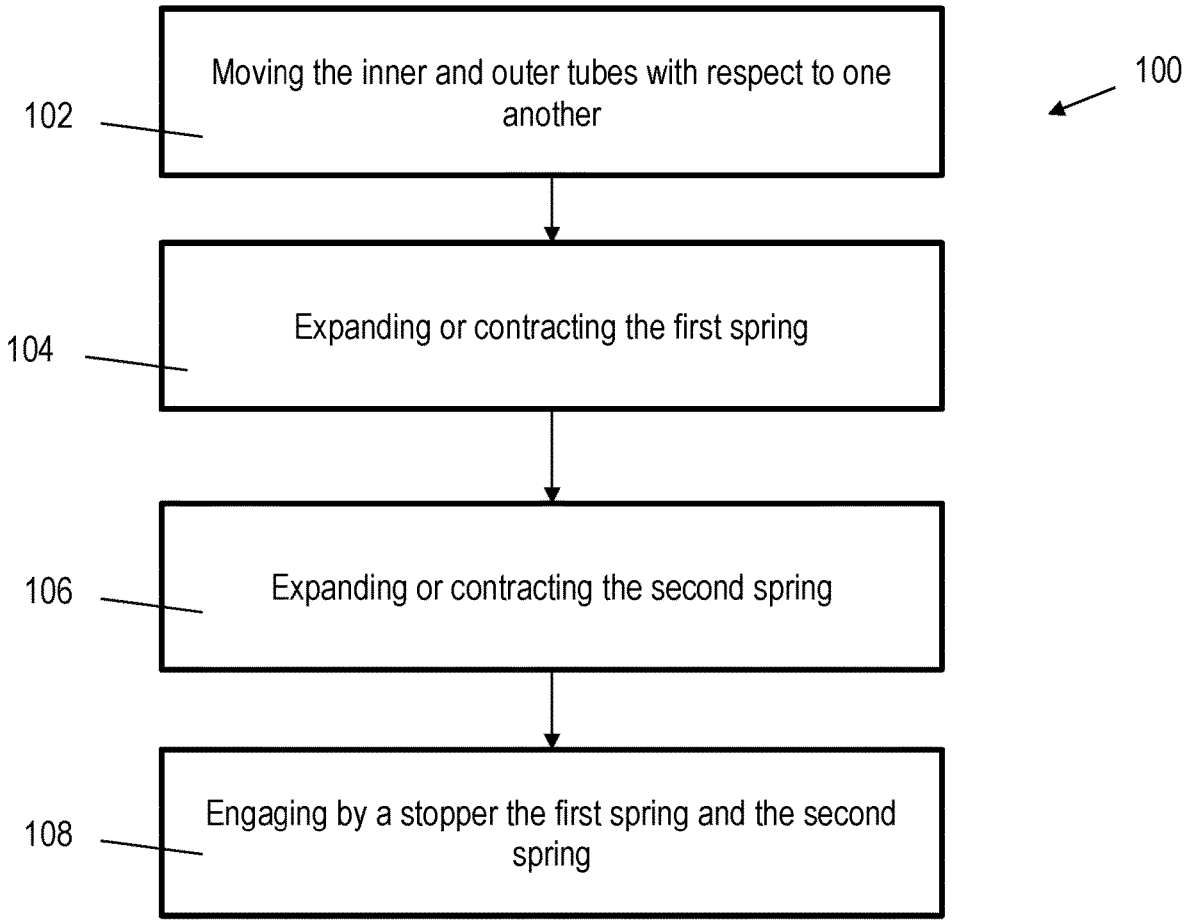
FIG. 11 is an example operation of the extension mechanism of FIG. 1.

Referring to FIG. 11, shown is an example method 100 of operation of the extension mechanism 15. The method 100 is for operating the extension mechanism 15 when coupled with the closure panel 14 to assist in opening and closing of the closure panel 14 of the vehicle 10 between a fully closed position and a fully open position of the closure panel 14. The method comprising the steps of: moving 102 the inner tube 26 relative to the outer tube 24 during the opening and closing, the inner tube 26 having the outer surface 34, the outer tube 24 having the inner surface 32 and overlapping the inner tube 26 for at least a portion of the outer surface 34 along the extension axis 21, such that the inner surface 32 and the outer surface 34 are adjacent to one another when overlapped, the seal being positioned between the inner surface 32 and the outer surface 34; expanding or contracting 104 the first spring 28, the first spring 28 positioned along the extension axis 21 in the interior 36*a* of the outer tube 24; expanding or contracting 106 the second spring 27, the second spring 27 positioned along the extension axis 21 in the interior 36*b* of the inner tube 26; and engaging 108 by the stopper 39 the first spring 28 at the one end 41*a* and the second spring 27 at the opposite end 41*b* such that the first spring 28 and the second spring 27 are in series with one another along the extension axis 21; wherein the one end 41*a* and the opposite end 41*b* are spaced apart from one another such that the seal 30 is positioned between the one end 41*a* and the opposite end 41*b*.

We claim:

1. An extension mechanism for coupling with a closure panel to assist in opening and closing of the closure panel of a vehicle between a fully closed position and a fully open position of the closure panel, the extension mechanism including:

an inner tube having an outer surface;

an outer tube having an inner surface and overlapping the inner tube for at least a portion of the outer surface along an extension axis, such that the inner surface and the outer surface are adjacent to one another when overlapped;

a first spring positioned along the extension axis in an interior of the outer tube;

a second spring positioned along the extension axis in an interior of the inner tube;

a seal positioned between the inner surface and the outer surface; and a stopper to engage the first spring at one end and engage the second spring at an opposite end such that the first spring and the second spring are in series with one another along the extension axis;

wherein the one end and the opposite end are spaced apart from one another such that the seal is positioned between the one end and the opposite end.

2. The extension mechanism of claim 1, further comprising the stopper slideable within the outer tube along the extension axis.

3. The extension mechanism of claim 1, wherein the first spring expands before the second spring begins to expand.

4. The extension mechanism of claim 1, wherein the extension mechanism is a component of a counterbalance mechanism for the vehicle.

5. The extension mechanism of claim 2 further comprising the stopper having a sleeve with a first abutting surface at the one end to engage with the second spring and a second abutting surface at the opposite end to engage with the first spring.

6. The extension mechanism of claim 5, wherein the second abutting surface at the opposite end is provided as an upstanding lip from the sleeve.

7. The extension mechanism of claim 5, wherein the first abutting surface at the one end is provided as an upstanding lip from the sleeve.

8. The extension mechanism of claim 1, wherein a diameter of the stopper at the one end is greater than a diameter of the stopper at the other end.

9. The extension mechanism of claim 5 further comprising a depression in the sleeve for allowing the stopper to slide relative to the seal.

10. The extension mechanism of claim 5, wherein a length of the sleeve along the extension axis defines a distance between the first abutting surface and the second abutting surface.

11. The extension mechanism of claim 1 further comprising a third spring positioned in a support tube in the interior of the inner tube.

12. The extension mechanism of claim 5, wherein the sleeve is a hollow tube.

13. The extension mechanism of claim 5, wherein the first abutting surface and the second abutting surface are ring like structures connected to the sleeve.

14. An extension mechanism for coupling with a closure panel to assist in opening and closing of the closure panel of a vehicle between a fully closed position and a fully open position of the closure panel, the extension mechanism including:

an inner tube having an outer surface;

an outer tube having an inner surface and overlapping the inner tube for at least a portion of the outer surface along an extension axis, such that the inner surface and the outer surface are adjacent to one another when overlapped;

a first spring positioned along the extension axis in an interior of the outer tube;

a second spring positioned along the extension axis in an interior of the inner tube; and a stopper to engage the first spring at one end and engage the second spring at an opposite end such that the first spring and the second spring are in series with one another along the extension axis;

wherein the stopper is configured to move during one of an expansion or a compression of at least one of the first spring and the second spring.

15. A method for operating an extension mechanism coupled with a closure panel to assist in opening and closing of the closure panel of a vehicle between a fully closed position and a fully open position of the closure panel, the method comprising the steps of:

moving an inner tube relative to an outer tube during said opening and closing, the inner tube having an outer surface, the outer tube having an inner surface and overlapping the inner tube for at least a portion of the outer surface along an extension axis, such that the inner surface and the outer surface are adjacent to one another when overlapped, a seal being positioned between the inner surface and the outer surface;

expanding or contracting a first spring, the first spring positioned along the extension axis in an interior of the outer tube;

expanding or contracting a second spring, the second spring positioned along the extension axis in an interior of the inner tube; and engaging by a first end of the stopper the first spring at one end and the second spring at an opposite second end of the stopper such that the first spring and the second spring are in series with one another along the extension axis;

wherein the first end and the second end are spaced apart from one another such that the seal is positioned between the first and second end.

16. The method of claim 15 further comprising the stopper slideable within the outer tube along the extension axis.

17. The method of claim 15, wherein the first spring expands before the second spring begins to expand.

18. The method of claim 15 further comprising the stopper having a sleeve with a first abutting surface at the one end to engage with the second spring and a second abutting surface at the opposite end to engage with the first spring.

19. The method of claim 15, wherein a diameter of the stopper at the one end is greater than a diameter of the stopper at the other end.

20. The method of claim 18 further comprising a depression in the sleeve for retaining the seal.

* * * * *